US008437916B2

(12) United States Patent
Fawaz et al.

(10) Patent No.: US 8,437,916 B2
(45) Date of Patent: May 7, 2013

(54) UNIVERSAL GARAGE DOOR OPENER AND APPLIANCE CONTROL SYSTEM

(75) Inventors: Mike Fawaz, Plymouth, MI (US); Riad Ghabra, Dearborn Heights, MI (US); Jason T. Summerford, Novi, MI (US); Bryan Vartanian, Livonia, MI (US)

(73) Assignee: Lear Corporation, Southfield, MI (US)

( * ) Notice: Subject to any disclaimer, the term of this patent is extended or adjusted under 35 U.S.C. 154(b) by 321 days.

(21) Appl. No.: 12/904,354

(22) Filed: Oct. 14, 2010

(65) Prior Publication Data

US 2011/0172885 A1 Jul. 14, 2011

Related U.S. Application Data

(60) Provisional application No. 61/335,949, filed on Jan. 14, 2010.

(51) Int. Cl.
*G08C 19/00* (2006.01)

(52) U.S. Cl.
USPC ..... 701/48; 455/418

(58) Field of Classification Search ..... 701/2, 36, 701/47, 48; 455/418–420, 41.1, 41.2, 68–71, 455/88, 569.2, 575.1, 9, 90.1–90.3, 95, 99, 455/344–345; 340/5.1, 5.2, 5.21–5.26, 5.31–5.33, 340/5.7

See application file for complete search history.

(56) References Cited

U.S. PATENT DOCUMENTS

| | | | | |
|---|---|---|---|---|
| 6,072,436 | A | 6/2000 | Marougi | |
| 7,039,397 | B2 | 5/2006 | Chuey | |
| 7,084,781 | B2 * | 8/2006 | Chuey | 340/12.23 |
| 7,269,416 | B2 * | 9/2007 | Guthrie et al. | 455/420 |
| 7,692,533 | B2 * | 4/2010 | Chiba et al. | 340/426.1 |
| 2005/0192727 | A1 | 9/2005 | Shostak et al. | |
| 2007/0024510 | A1 | 2/2007 | Ghabra et al. | |
| 2007/0290881 | A1 | 12/2007 | Nikitin et al. | |
| 2011/0043328 | A1 * | 2/2011 | Bassali | 340/5.71 |

* cited by examiner

*Primary Examiner* — Dalena Tran
(74) *Attorney, Agent, or Firm* — Brooks Kushman P.C.

(57) ABSTRACT

A control module may be configured to support wireless transmission and/or receipt of signals used to direct universal garage door openers and other appliance control systems. The control module may be operable to prevent certain garage door opener and/or application control requests in the event certain security measures are not met. The control module may be integrated into a smart junction box, body control module, and/or other module in the event the control module is adapted for use within a vehicle.

20 Claims, 5 Drawing Sheets

UNIVERSAL GARAGE DOOR OPENER AND APPLIANCE CONTROL SYSTEM

CROSS-REFERENCE TO RELATED APPLICATIONS

This application claims the benefit of U.S. provisional Application No. 61/335,949 filed Jan. 14, 2010. The disclosure of which is incorporated in its entirety by reference herein.

TECHNICAL FIELD

The present invention relates to universal garage door openers and appliance control systems, such as but not limited to the type that may be incorporated into a vehicle.

BACKGROUND

Home appliances, such as garage door openers, security gates, home alarms, lighting, and the like, may conveniently be operated from a remote control. In some cases, the remote control may be purchased together with the appliance. The remote control transmits a radio frequency activation signal which is recognized by a receiver associated with the appliance, such as for use in controlling the operation thereof. Aftermarket remote controls are gaining in popularity as such devices can offer functionality different from the original equipment's remote control. Such functionality includes decreased size, multiple appliance interoperability, increased performance, and the like. Aftermarket controllers are also purchased to replace lost or damaged controllers or to simply provide another remote control for accessing the appliance.

An example application for aftermarket remote controls are remote garage door openers integrated into an automotive vehicle. These integrated remote controls provide customer convenience, appliance interoperability, increased safety, and enhanced vehicle value. One problem with such devices is the potential of an unauthorized user gaining access to the vehicle to direct undesirable control of the garage door opener, such as by reaching through an open window and activating a button included on a garage door opener interface mounted within an interior of the vehicle.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION

Figure 1:
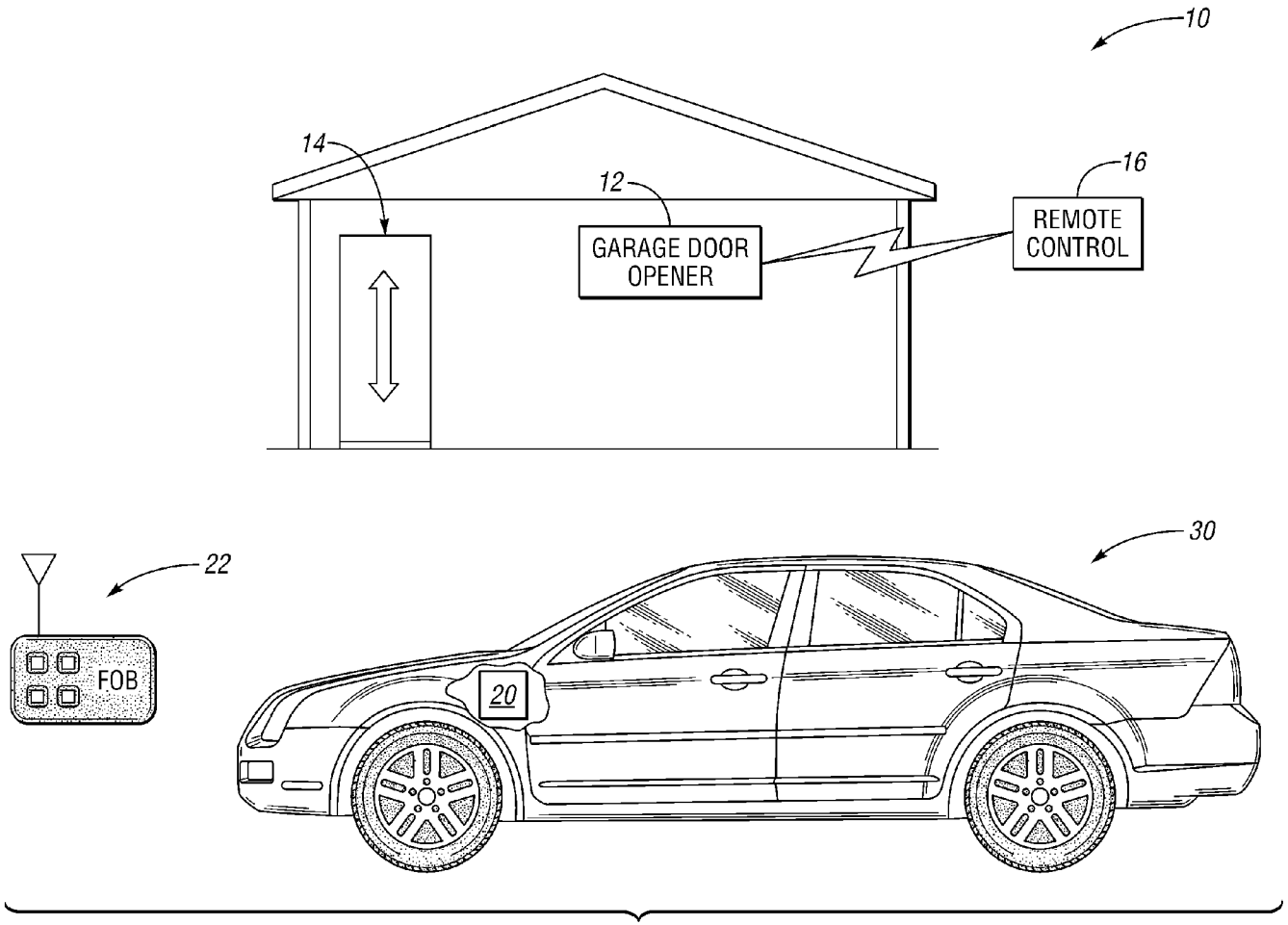
FIG. 1 illustrates an appliance system in accordance with one non-limiting aspect of the present invention.

FIG. 1 illustrates an appliance system 10 in accordance with one non-limiting aspect of the present invention. The present invention contemplates wirelessly controlling any number of appliances and types of appliances, such as but not limited to home appliances, and for exemplary purposes, is predominately described with respect to the wirelessly controlled appliance being a garage door opener 12. The garage door opener (GDO) 12 may be operable to actuate a garage door 14 in an up and down manner, or otherwise between opened and closed positions, or some position therebetween, such as to control access to a home garage. The wireless control is shown to be facilitated with wireless signals sourced from a remote control 16 purchased with the garage door opener 12, a vehicle control module 20, and a portable wireless fob 22.

The fob 22 may include a transmitter (not shown) operable to transmit wireless garage door signals directly to the garage door opener 12 or to the vehicle control module 20 for relay to the garage door opener 12. The fob 22 may include a number of buttons, a touch screen, or other user interface to facilitate receiving garage door opener related commands from a user. The vehicle control module 20 may be operable in cooperation with a GDO interface 28 (see FIG. 2) mounted to a vehicle, such as within the passenger compartment (instrument panel, headliner, steering wheel, etx.) or on an exterior door panel. In this manner, a user positioned within or near the vehicle 30 or in possession of the fob 22 may be able to control one or more garage door related events by interacting with the GDO interface 28 or fob 22. The vehicle control module 20 and fob 22 may be programmed with or otherwise operable to learn a code or other messaging requirement of the garage door opener 12 in order to facilitate proper transmission of the garage door signals.

Figure 2:
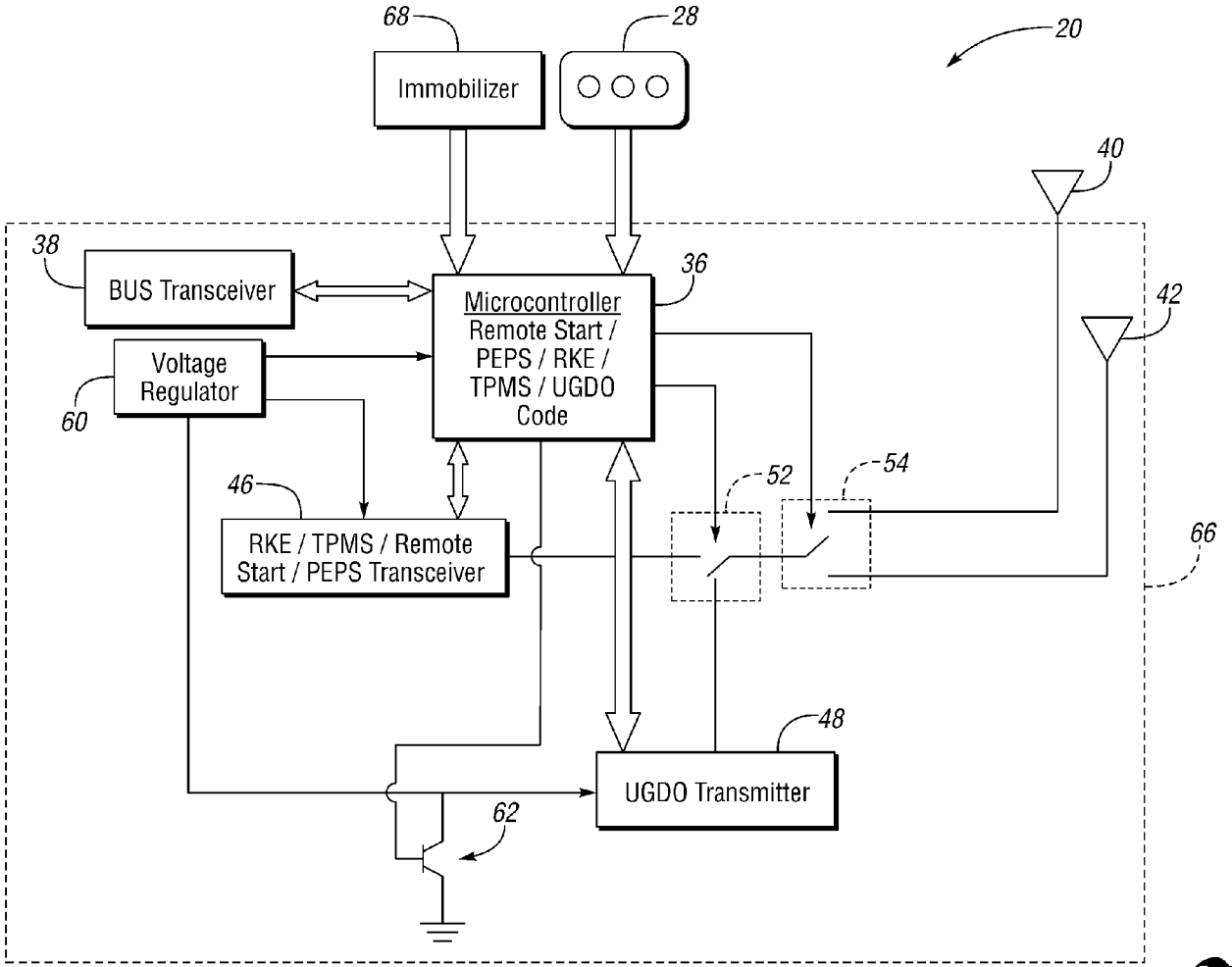
FIG. 2 illustrates a vehicle control module in accordance with one non-limiting aspect of the present invention.

FIG. 2 illustrates the vehicle control module 20 in accordance with one non-limiting aspect of the present invention. The vehicle control module 20 may be included as part of a smart junction box (SJB), body control module (BCM) and/or other module included with the vehicle 30 and having a microcontroller 36 operable to support the operations contemplated by the present invention. The microcontroller 36 may include a processor, memory, I/O and/or other features necessary to support the operations contemplated by the present invention. One non-limiting aspect of the present invention contemplates the microcontroller 36 being operable to support remote start (RS), passive entry passive start (PEPS), remote keyless entry (RKE), tire pressure monitoring system (TPMS), and/or universal garage door opener (UGDO) (also referred to interchangeably herein as GDO) related operations. Code required to support theses and other operations may be stored on the microcontroller memory.

One or more of the operations supported by the microcontroller 36 may be considered as wireless-based controls in the event signals indicating a request to implement a particular control originate from a wireless source, i.e. fob, passive entry device (may be included as part of fob), and tire pressure monitoring element or in the event the implemented control requires transmission of wireless signals. Optionally, the vehicle control module 20 may include a BUS transceiver 38 or other suitable network interface to facilitate communication of messages and other signals to the microcontroller 36 and/or a direct connect to the GDO interface 28. In the event the controls commanded by the microcontroller 36 involve controlling one or more vehicle subsystems to implement a particular operation, the microcontroller 36 may transmit suitable instructions/commands to those vehicle subsystems by way of the BUS transceiver 38, such as but not limited to commands formatted according to CAN, LIN, or other network protocols.

In addition to communications carried out through the BUS interface 38, the microcontroller 36 may also be operable to wireless communication through one or more vehicle antennas 40, 42. FIG. 2 illustrates a first antenna 40 being included outside of the vehicle control module 20 and a second antenna 42 being included within the vehicle control module 20. The first antenna 40 may be mounted in a particular area of the vehicle 30 suited to certain types of communications, such as to support RS, UGDO, RKE, and PEPS related operations. While only one first antenna 40 is shown, the present invention fully contemplates the use of multiple antennas exterior to the vehicle control module 20 and an ability to selective switch signal delivery to the exterior antennas 40 most suitable to a particular operation. The second antenna 42 may be included within the vehicle control module 20 to support operations where a wireless range of communication is shorter, such as to support TPMS related operations. While only one second antenna 42 is shown, the present invention fully contemplates the use of multiple antennas interior to the vehicle control module 20 and an ability to selective switch signal delivery to the interior antennas most suitable to a particular operation.

The vehicle control module 20 may include a transceiver 46 and a transmitter 48 operable with one or more of the first and second antennas 40, 42, or additional antennas if used, through connections provided through one or more corresponding switches 52, 54. The switches 52, 54 may be controlled by the microcontroller 36 to selectively, and optionally simultaneously, connect one or more of the transceiver 46 and transmitter 48 to one or more of the antennas 40, 42. The transceiver 46 may be operable to support two-way type communications, such as those required to support RS, TPMS, RKE, and PEPS related operations. The transmitter 48 may be a more limited device operable to support only one-way, transmitting type communications, such as those required to support UGDO related operations. Of course, the transmitter 48 may be replaced with a transceiver in the event the GDO 12 supports two-way communications and/or the operations performed by the transmitter 48 may be performed by the transceiver 46.

The vehicle control module 20 may include a voltage regulator 60 operable to regulate voltage and/or current provided to power the microcontroller 36, transceiver 46, and transmitter 48. The voltage regulator 60 may be operable to regulate energy provided from a vehicle battery (high or low voltage), capacitor, generator, charger, or other vehicle based energy source. The operation of the voltage regulator may be controlled by the microcontroller 36, such as to selectively provide the same or different energy to one or more of the transceiver 46 and transmitter 48, including capabilities to prevent the flow of energy to either one of the transceiver 46 and transmitter 48. The voltage regulator 60 may also be a passive device, such as the type configured to provide a constant output regarding of input fluctuations.

The vehicle control module 20 may include a transistor 62 or other suitable element between the voltage regulator 60 and the transmitter 48. The transistor 62 may be controlled by the microcontroller 36 to short or otherwise prevent the voltage regulator 60 from powering the transmitter 48. This type of arrangement may be advantageous in preventing transmission of vehicle originating garage door signals in the absence of microcontroller authorization. One non-limiting aspect of the present invention contemplates the microcontroller 36 preventing powering of the transmitter 48 when security of the GDO interface 28 may be compromised, such as when a vehicle window is down, the vehicle is locked, or other conditions or combinations thereof occur where a non-authorized individual may be able to reach the GDO interface 28 to direct what would be characterized as a non-authorized or undesirable GDO event.

The boundaries of the vehicle control module 20 may be equivalent to boundaries of a printed circuit board (PCB) 66, or other similarly functioning element, used to support and/or electrically connect the illustrated elements together. The PCB 66 may include additional components, such as those associated with operation of a SJB and/or BCM, and/or the PCB 66 may be one of one or more PCBs used to support other components associated with the SJB and/or BCM. Optionally, the microcontroller 36 may include capabilities to support or otherwise implement SJB and BCM related operations. The vehicle control module components and the SJB, BCM, or other module, components may be enclosed within a single housing (see FIG. 1). The housing may be sufficiently adapted to be mounted within an instrument panel area of the vehicle 30, optionally, within an area of the instrument panel hidden from normal viewing angles of vehicle occupants.

An immobilizer 68 may communicate through the BUS transceiver 38 or directly (as shown) with the microcontroller 36. The immobilizer 68 may be configured to indicate whether an authorized key is within an ignition switch (not shown). The immobilizer 68 may be used to grant and deny certain vehicle operations depending on whether the key within the ignition includes a wireless chip having keys matching with those authorized to control the vehicle 30. For example, a valet key may be used to drive the vehicle but it may not have the same wireless chip or chip characteristics of the key authorized to fully control the vehicle 30. The immobilizer 68 may be operable to a disarmed state when the fully authorized key is inserted and to an armed state when the less than fully authorized key is inserted.

Figure 3:
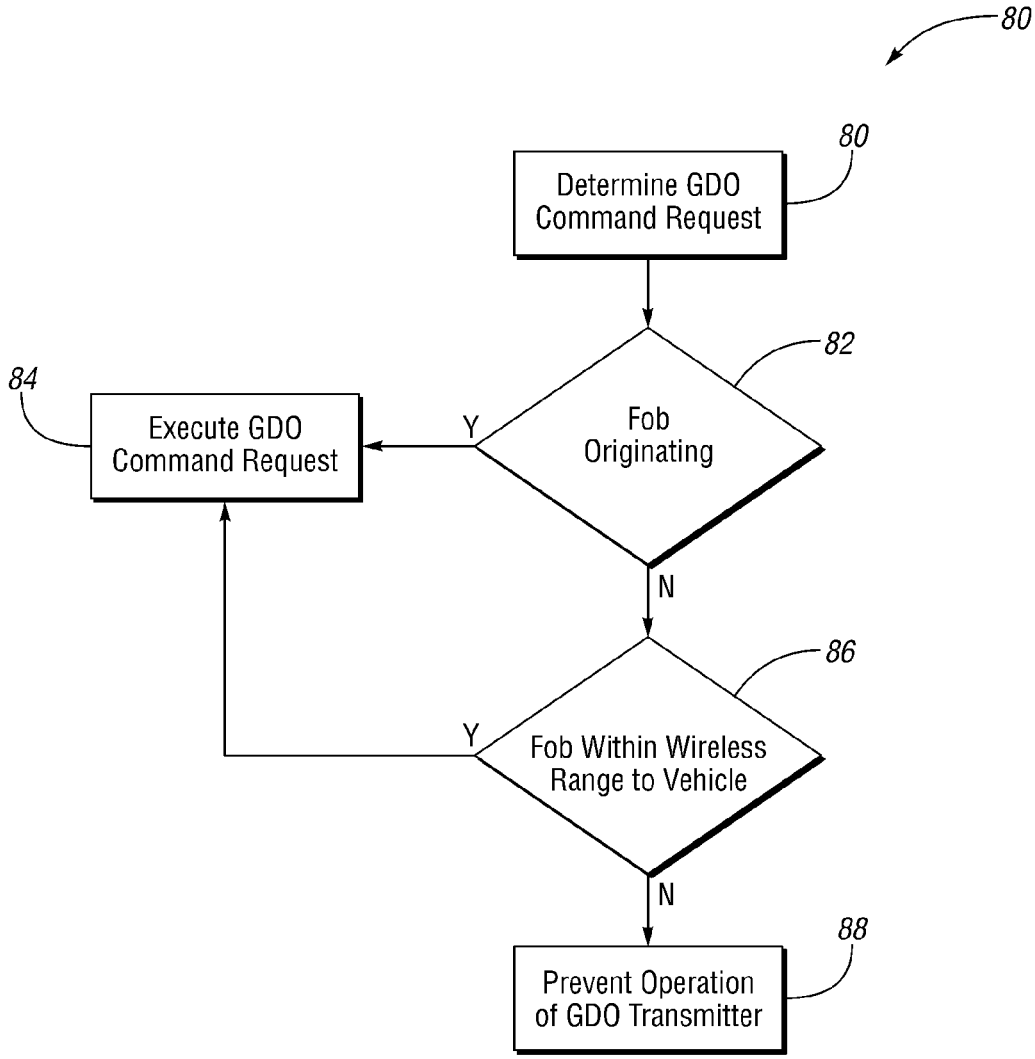
FIG. 3 illustrates a flowchart of an appliance control method in accordance with one non-limiting aspect of the present invention.

FIG. 3 illustrates a flowchart 80 of an appliance control method in accordance with one non-limiting aspect of the present invention. The method is predominately described with respect to controlling the GDO 12 for exemplary, non-limiting purposes and would apply equally to control of other appliances. The method may be embodied in a computer-readable medium or other medium suitable for storing code or other executable programming, such as for execution with but not limited to the microcontroller 36, or other device sufficiently operable to support execution of the operations necessary to implement the methods contemplated by the present invention.

Block 80 relates to the microcontroller 36 determining a GDO command request, such as a command to open or close to garage door or to perform some other operation. The GDO command request may originate from one of the fob 22 and GDO interface 28. The microcontroller 36 may determining the request according to wireless signals received from the fob 22, through the direct connection to the GDO interface, and/or through signals received through the BUS transceiver 38. In the case of the signals originating from the fob 22, the GDO commands may be received through two-way, non-GDO communications with the fob 22, i.e., instead of communicating with the microcontroller 36 through the GDO transmitter 48 using GDO formatting signaling, the corresponding signaling may be formatted according to RS, RKE, TPMS, and/or PEPS used by the transceiver 46 to support two-way communications.

Block 82 relates to the microcontroller 36 determining whether the GDO command originated from the vehicle 30 or from outside the vehicle 30, which may be determined, for example, based on whether the GDO command originated from the fob 22 or GDO interface 28. This determination, or a similar determination, may be helpful in assessing security of the source requesting the GDO action. The fob 22, for example, may have a greater level of presumed security than a source connected to the vehicle 30 since there are a limited number of fobs 22 authorized to control the vehicle 30 and those fobs 22 typically travel on the person of persons authorized to control the vehicle 30. The vehicle-mounted source 20, in contrast, may not have the same level of presumed security since those sources can be actuated by non-authorized persons when the vehicle 30 is unlocked or a window is down.

In the event the GDO command originates from the fob 22, the related GDO operation may be instigated in Block 84 with the microcontroller 36 instructing the transmitter 48 to transmit the corresponding signaling, and optionally, with the microcontroller 36 controlling the antenna switches 52, 54 to connect the appropriate antenna 40, 42 to the transceiver 48. The fob 22 issuing the GDO command may be required to pass an authentication test prior to the requested action being granted in Block 84. The authentication test may simply require the fob to be within a wireless range to the vehicle 30, i.e., a range in which the vehicle 30 may be able to wirelessly communicate with the fob 22, which may vary depending to the antenna 40, 42 used to the support the related signaling, and/or that the requesting fob 22 also exchange authenticating keys or perform some other mating operation with the microcontroller 36 in order to insure the requesting fob 22 is authorized to control and direct operations of the microcontroller 36.

Block 86 relates to the microcontroller 36 performing an additional security check prior to the granting the requested GDO command in Block 84 or denying the requested GDO command in Block 88. The additional security check may be used to insure the conditions attendant to the request are those that are or tend to reflect conditions which would occur with authorized access to the vehicle 30. This security test may be tailored to the present vehicle conditions, i.e., different test may be performed depending on whether the vehicle 30 is locked and/or the windows are down.

Block 86 is shown to test based on the presence of a mated or authenticated fob 22 within the wireless range to the vehicle 30, and optionally, based on whether the fob 22 is authorized to control the vehicle 30 (fobs 22 may be mated with vehicle types but authenticated to control a specific vehicle) or whether another authorization even has taken place, such as by a user keying in a code to the vehicle door pad, etc. Optionally, the armed and disarmed state of the immobilizer 68 may be used as a further test in that the GDO command may be prevented when a sufficiently authorized fob is not found within the wireless range unless the immobilizer is in the disarmed state.

Block 88 relates to the microcontroller 36 preventing the GDO command request in the event the security check of Block 86 is not passed. The GDO prevention may include instructing the GDO transmitter 48 to ignore any requests to transmit GDO signals to the GDO 12. In the case of the GDO transmitter 48 being a slave transmitter or otherwise being unable to ignore such GDO requests or in order to otherwise prevent any such decision making, the GDO prevention may include the microcontroller 36 controlling the switch 62 used to connect the GDO transmitter 48 to the voltage regulator 60 to an open position in order to prevent powering of the GDO transmitter 48 or controlling the antenna switches 52, 54 to disconnect the transmitter 48 from the antenna 40, 42 required to properly transmit the GDO signals.

Figure 4:
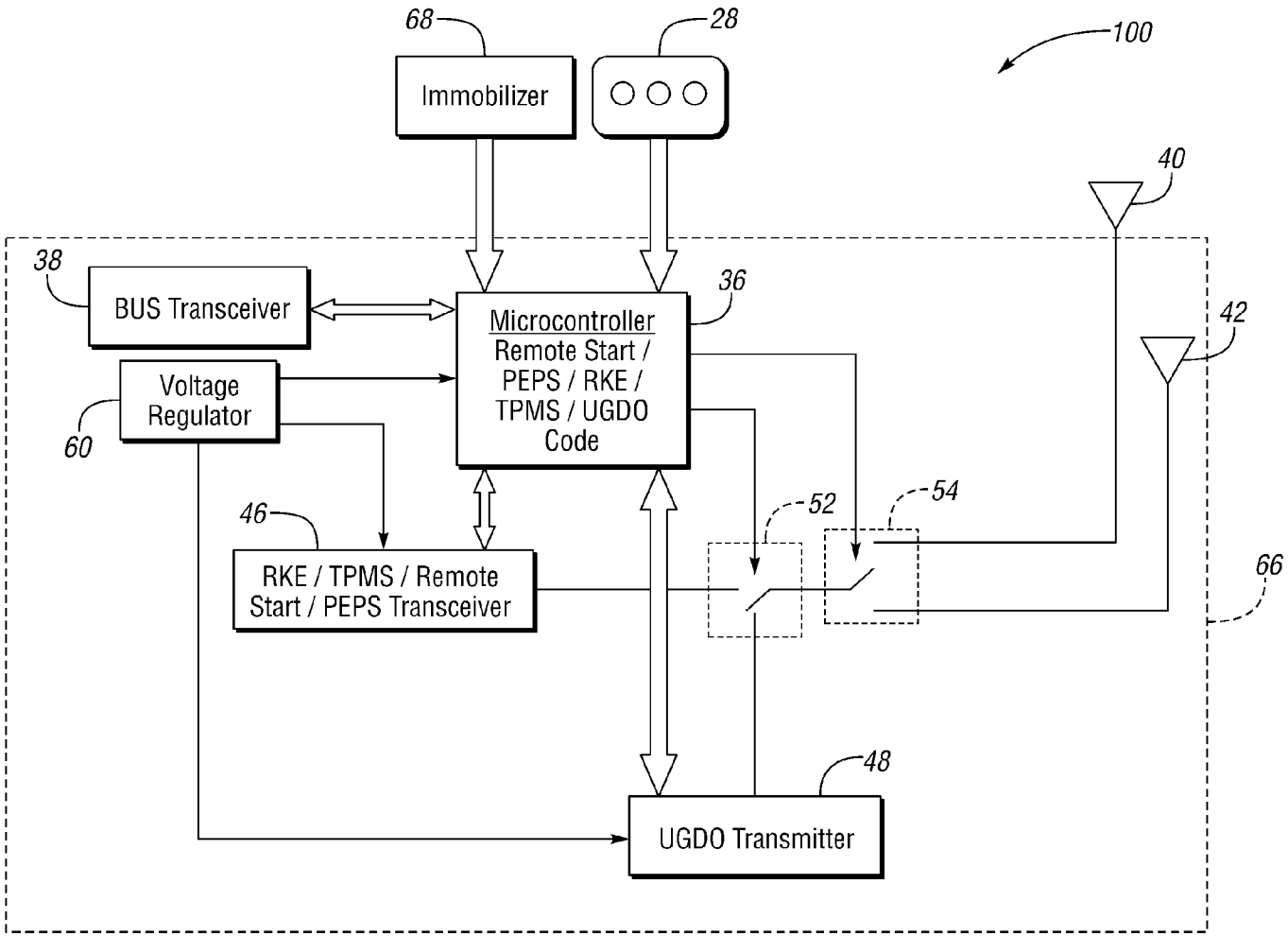
FIG. 4 illustrates a vehicle control module in accordance with one non-limiting aspect of the present invention.

FIG. 4 illustrates a vehicle control module 100 in accordance with one non-limiting aspect of the present invention. The vehicle control module 100 includes many of the same components as the vehicle control module 20 shown in FIG. 2. The common features are referred to with the same reference numbers in both Figures. The vehicle control module 100 of FIG. 4 varies at least in so far as use of the transistor 62 has been omitted in favor of a software control methodology whereby the microcontroller issues commands/instructions to the transmitter 48 in order to prevent the transmitter from issuing GDO commands to the GDO 12. The microcontroller 36 is operable to detect various operating parameters and selectively enable and disable the transmitter 48 as a function thereof. Each request made for the transmitter 48 to issue a GDO command may be verified by the microcontroller and specifically authorized with a corresponding enable/disable message. The microcontroller 36 may review and issue enable/disable message for each request and/or blanket instructions may be provided for certain periods of time instead of requiring the microcontroller 36 to separately issue instructions for each request.

Figure 5:
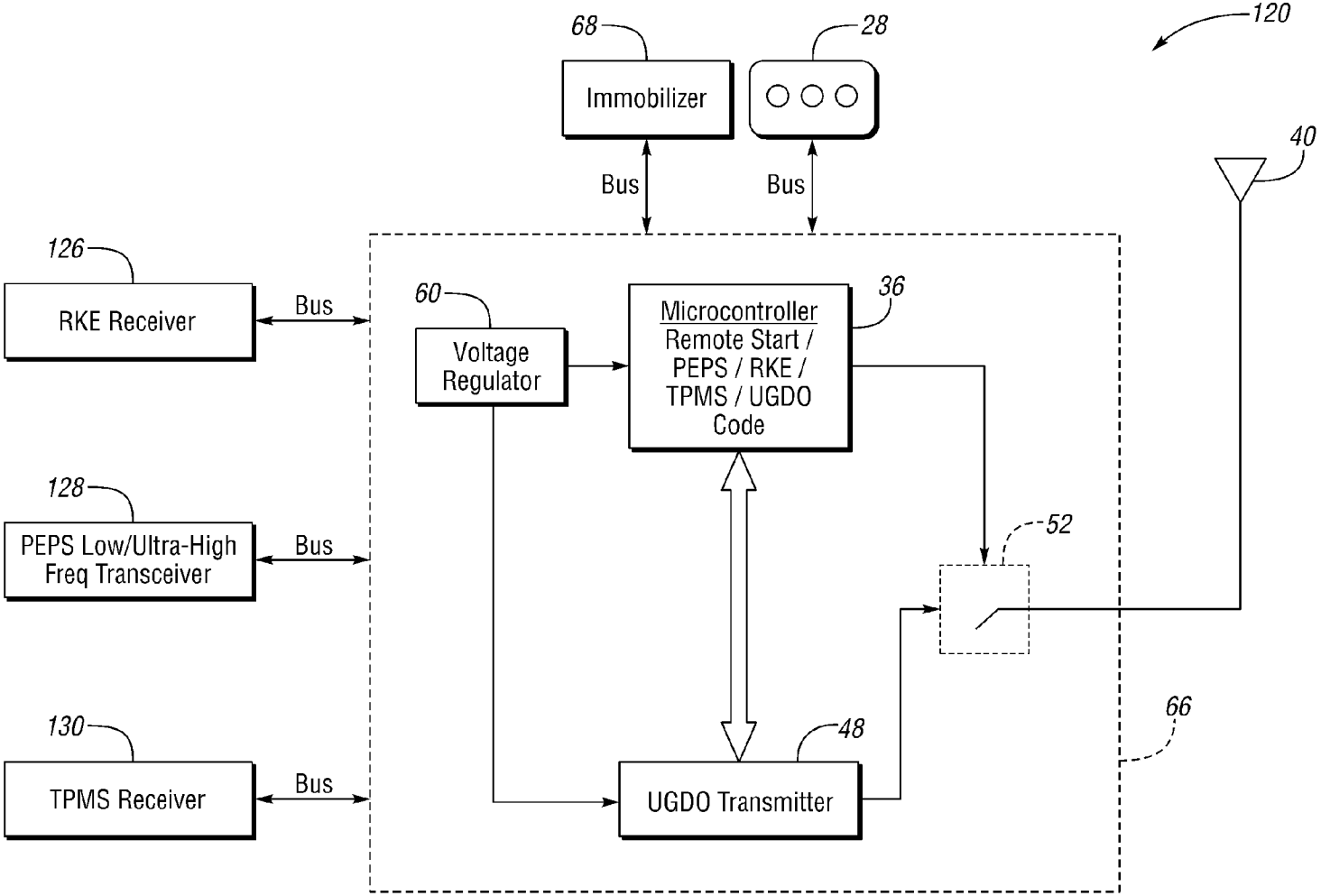
FIG. 5 illustrates a vehicle control module in accordance with one non-limiting aspect of the present invention.

FIG. 5 illustrates a vehicle control module 120 in accordance with one non-limiting aspect of the present invention. The vehicle control module 120 includes some of the same components as the vehicle control module 20 shown in FIG. 2. The common features are referred to with the same reference numbers in both Figures. The vehicle control module 120 of FIG. 5 varies at least in so far as use of the transistor 62 has been omitted in favor of a software control methodology whereby the microcontroller issues commands/instructions to the transmitter 48 in order to prevent the transmitter from issuing GDO commands to the GDO 12. The vehicle control module 120 varies further in that the switch 52 is controlled to selectively switch the antenna 40 between the microcontroller 36 and transmitter 48 depending on the entity authorized to transmit signals during the current period of time. The vehicle control module 120 varies further in that the transceiver 46 has been removed from the PCB 66. The transceiver 46 are shown to separate elements 126, 128, 130, optionally on separate PCBs located through the vehicle 30, whereby the operations thereof facilitate by the microcontroller 36 are implement at least partially based on signals carried over corresponding buses therebetween.

As supported above, one non-limiting aspect of the present invention is intended to apply to any number of remotely controllably systems, such as but not limited to a universal garage door opener (UGDO) and appliance control system disclosed in U.S. Pat. No. 7,039,397, entitled User-Assisted Programmable Appliance control, the disclosure of which is hereby incorporated in its entirety. As opposed to some systems where a dedicated microcontroller is used to support UGDO related processing, one non-limiting aspect of the present invention contemplates integrating the UGDO logic within a body control module (BCM), smart junction box (SJB), or some other microcontroller based vehicle system so as to eliminate the need for a dedicated UGDO microcontroller.

A RF section used to facilitate the wireless communications between the vehicle and a garage door or other controlled appliance may be connected to a microcontroller by way of a vehicle network, such as a LIN or CAN protocol compliant network. This arrangement may require conversion or encapsulation of UGDO related commands at the microcontroller end into the compliant protocol and then decoded back to the UGDO based commands understood by the UGDO RF section. In comparison to systems having a dedicated UGDO microcontroller, this process may add additional processing to support communications over the vehicle bus.

UGDO buttons may be included within a vehicle dash or instrument panel together with RF section may be located remotely from microcontroller. In this implementation, the microcontroller in the BCM or SJB may execute computations necessary for learning and for operation of UGDO functions. Control of the RF section and button sensing may be communicated over the bus such that the architecture provides a cost reduction by utilizing microcontroller in the BCM/SJB and enhances security by allowing UGDO function only if vehicle is authorized (via fob, key, keypad, etc.), i.e., if one has successfully entered the vehicle and/or started the vehicle in the case where the BCM or SJB is non-function until vehicle start.

Optionally, the UGDO buttons may be located remotely from the microcontroller along with the RF section and antenna. In this implementation, the microcontroller in the BCM or SJB may execute all the computations necessary for learning and for operation of UGDO functions. Control of RF section and button sensing may be communicated over the bus. This architecture may provide a cost reduction by utilizing a microcontroller in the BCM/SJB plus it may enhance security by allowing UGDO function only if a proper authorization event has occurred. In addition, this architecture may also allow the placement of the RF section in the most RF-friendly spot while allowing the buttons to be located in an ergonomic location which is often different than the best location for RF.

The RF section (i.e., components required to support the noted wireless operations) may be located in the BCM/SJB, and the RF antenna may be located in a position which is RF friendly. In this implementation, the microcontroller in the BCM or SJB may execute all the computations necessary for learning and for operation of UGDO functions. Button sensing may be communicated over the bus (or hardwired). This architecture may provide a cost reduction by integrating the micro and RF section in the BCM/SJB plus it may enhance security by allowing UGDO function only if vehicle is authorized. In addition, this architecture may also allow the placement of the RF antenna in the most RF-friendly spot while allowing the buttons to be located in an ergonomic location which is often different than the best location for RF.

When an UGDO button is pressed, the microcontroller may automatically switch the RF antenna from the RKE/PKE/TPM receiver to the UGDO transmitter circuit. After the requested UGDO function is performed and completed, the microcontroller may switch the RF antenna back to the RF receiver circuit. In this way, a single RF antenna may be located optimally and used for both UGDO and RKE/PKE/TPM functions for cost reduction and packaging simplification. Optionally, an additional antenna may be included to eliminate the antenna switching.

The fob may include RKE push-buttons that may be selectively activated by an operator to generate a RKE demand signal for locking or unlocking vehicle doors, opening or closing a vehicle sliding door, unlocking a vehicle trunk, activating internal and/or external vehicle lights, activating a "panic" alarm, and/or performing a variety of other vehicle related functions. It should be noted that while the present invention has been described herein as implementing push-buttons, any appropriate man-machine interface device (e.g., touch screen, switch, and the like) may be implemented to meet the design criteria of a particular application.

As required, detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention. The features of various implementing embodiments may be combined to form further embodiments of the invention.

What is claimed is:

1. A vehicle control module comprising:

a single microcontroller being operable to control one or more vehicle subsystems to implement at least one of remote start (RS), passive entry passive start (PEPS), remote keyless entry (RKE), tire pressure monitoring system (TPMS), and universal garage door opener (UGDO) operations;

a transceiver being operable with the microcontroller to facilitate signaling with at least one antenna used to facilitate RS, PEPS, RKE, and TPMS operations; and a UGDO transmitter being operable with the microcontroller to facilitate signaling with at least one antenna used to facilitate UGDO operations;

wherein the microcontroller is further operable to prevent UGDO operations when an authenticated fob is beyond a wireless range to the vehicle.

2. The vehicle control module of claim 1 wherein the microcontroller, transceiver, and UGDO transmitter are each included within a common housing.

3. The vehicle control module of claim 2 wherein the microcontroller, transceiver, and UGDO transmitter are each mounted to the same printed circuit board (PCB).

4. The vehicle control module of claim 2 wherein the housing is further configured to be mounted and concealed within an instrument panel of the vehicle.

5. The vehicle control module of claim 2 wherein at least one of the at least one antenna is included within the housing.

6. The vehicle control module of claim 2 further comprising a voltage regulator for providing energy from a vehicle battery to the microcontroller, transceiver, and UGDO transmitter being included within the housing.

7. The vehicle control module of claim 1 further comprising a network interface operable to exchange signals between the microcontroller and the one or more vehicles subsystems to implement the RS, PEPS, RKE, TPMS, and UGDO operations.

8. The vehicle control module of claim 1 wherein the microcontroller includes a memory to store code required to direct implementation of the RS, PEPS, RKE, TPMS, and UGDO operations.

9. The vehicle control module of claim 1 wherein the microcontroller is further operable to selectively switch the transceiver and the UGDO transmitter between two or more antennas.

10. The vehicle control module of claim 1 wherein the microcontroller is further operable to prevent UGDO operations when an authenticated fob is beyond a wireless range to the vehicle unless an immobilizer of the vehicle is in a disarmed state.

11. The vehicle control module of claim 1 wherein the microcontroller is further operable to control locking/unlocking of the vehicle in response to receiving a lock/unlock signal in connection with RKE.

12. The vehicle control module of claim 11 wherein the microcontroller is further operable to control a switch used to connect the UGDO transmitter to a power source from a closed position to an open position in order to prevent powering of the UGDO transmitter.

13. The vehicle control module of claim 1 wherein the microcontroller is further operable to prevent UGDO operations by ignoring requests to perform UGDO operations.

14. The vehicle control module of claim 1 wherein the microcontroller is further operable to prevent UGDO operations by disconnecting the UGDO transmitter from the at least one antenna.

15. The vehicle control module of claim 1 wherein the microcontroller is further operable to permit UGDO operations when no authenticated fobs are within the wireless range to the vehicle in the event an immobilizer is disarmed.

16. A vehicle control module operable with a garage door opener (GDO) interface mounted to a vehicle through which a user interacts to request transmission of garage door signals to control a remotely located GDO, the vehicle control module comprising:

a GDO transmitter being operable to wirelessly transmit the garage door signals according to occupant interaction with the GDO interface; and a microcontroller being operable with one or more portable, wireless devices to implement wirelessly requested control of one or more vehicle-based subsystems upon authentication of the wireless devices; and wherein the microcontroller is further operable to prevent transmission of the garage door signals requested through the user interacting with the GDO interface in the absence of at least one of the wireless devices being authenticated.

17. The vehicle control module of claim 16 wherein the microcontroller prevents transmission of the garage door signals requested through the user interacting with the GDO interface in the event each of the one or more the wireless devices determined to be within a wireless range to the vehicle fail to successfully pass an authentication test.

18. The vehicle control module of claim 16 further comprising wherein the microcontroller is further operable to prevent transmission of the garage door signals requested through the user interacting with the GDO interface in the absence of at least one of the wireless devices being determined to be within a predefined wireless range to the vehicle and wherein the microcontroller prevents transmission of the garage door signals requested through the user interacting with the GDO interface by preventing a voltage regulator from powering the GDO transmitter.

19. A method of controlling a garage door opener (GDO) transmitter included within a vehicle, the GDO transmitter being operable to transmit garage door signals sufficient to control a GDO according to a user interacting with a GDO interface mounted to the vehicle, the method comprising:

a microcontroller being operable for determining whether one or more portable, authenticated wireless devices are within a wireless range of the vehicle; and preventing the GDO transmitter from transmitting any garage door signal in the event none of the portable, authenticated wireless devices are within the wireless range to the vehicle.

20. The method of claim 19 wherein a power source is required to provide power to the GDO transmitter in order for the GDO transmitter to transmit the garage door signals, and wherein the method further comprising preventing the GDO transmitter from receiving power from the power source in the event none of the wireless devices are within the wireless range to the vehicle.

* * * * *